United States Patent [19]

Gloomis et al.

[11] Patent Number: 4,638,533

[45] Date of Patent: Jan. 27, 1987

[54] VARIABLE RELEASE SEAT BELT BUCKLE

[75] Inventors: Lawrence A. Gloomis, Sterling Heights; Gregory S. Ches, Mt. Clemens, both of Mich.

[73] Assignee: General Motors Corporation, Detroit, Mich.

[21] Appl. No.: 723,571

[22] Filed: Apr. 15, 1985

[51] Int. Cl.[4] ..... A44B 11/26

[52] U.S. Cl. ..... 24/633; 24/573

[58] Field of Search ..... 24/3 F, 10 R, 10 A, 24/573, 574, 166, 633–642, 643–647, 650; 200/333, 340; 297/468; 292/DIG. 2, DIG. 11; 70/55, 56, DIG. 56; 150/52 R, 55, 56

[56] References Cited

U.S. PATENT DOCUMENTS

| | | | |
|---|---|---|---|
| 1,207,746 | 12/1916 | Goodnough | 24/3 F |
| 2,353,502 | 7/1944 | Reynolds | 24/3 F |
| 3,484,908 | 12/1969 | Lamb | 24/574 |
| 3,566,455 | 3/1971 | Kuszynski | 24/633 |
| 3,689,724 | 9/1972 | Labude | 200/333 X |
| 4,032,729 | 6/1977 | Koistinen | 200/340 X |
| 4,055,734 | 10/1977 | Hayden | 200/340 X |
| 4,062,091 | 12/1977 | Holmberg | 24/664 |
| 4,064,603 | 12/1977 | Romanzi . | |
| 4,497,094 | 2/1985 | Morris | 24/633 |
| 4,502,194 | 3/1985 | Morris et al. | 24/633 |

FOREIGN PATENT DOCUMENTS

| | | | |
|---|---|---|---|
| 2543159 | 4/1977 | Fed. Rep. of Germany | 24/640 |

*Primary Examiner*—Kenneth J. Dorner
*Assistant Examiner*—James R. Brittain
*Attorney, Agent, or Firm*—Charles E. Leahy

[57] ABSTRACT

A molded plastic tubular sleeve slips over the housing of a seat belt buckle and includes an integrally molded flap which registers with and overlies the pushbutton of the buckle. The pushbutton flap is plastically yieldable relative to the tubular sleeve to thereby depress the buckle pushbutton underlying the flap. By controlling the material and dimensions of the tubular sleeve, the pushbutton flap can be designed to require a level of release force which is predeterminedly larger than the force normally needed to unbuckle the buckle. Furthermore, the tubular sleeve is shaped to be capable of sliding removal from the buckle so that the seat belt buckle may be conveniently restored to normal force unbuckling as desired.

2 Claims, 4 Drawing Figures

VARIABLE RELEASE SEAT BELT BUCKLE

The invention relates generally to a seat belt buckle and more particularly to a buckle in which the pushbutton force for releasing the buckle may be varied.

BACKGROUND OF THE INVENTION

It is well known in motor vehicles to restrain an occupant on a vehicle seat through the use of a safety belt having a buckle interposed therein so that the belt can be separated to permit occupant ingress and egress.

Conventional seat belt buckles have a pushbutton which the occupant depresses to unbuckle the belt. The pushbutton is spring-loaded and the force of the spring determines the force the occupant must apply to unbuckle the buckle.

It would be desirable to provide a seat belt buckle having a device conveniently associated therewith for varying the pushbutton force needed to unbuckle the buckle.

SUMMARY OF THE INVENTION

According to the invention, a molded plastic tubular sleeve slips over the housing of a seat belt buckle and includes an integrally molded flap which registers with and overlies the pushbutton of the buckle. The pushbutton flap is plastically yieldable relative to the tubular sleeve to thereby depress the buckle pushbutton underlying the flap. By controlling the material and dimensions of the tubular sleeve, the pushbutton flap can be designed to require a level of release force which is predeterminedly larger than the force normally needed to unbuckle the buckle. Furthermore, the tubular sleeve is shaped to be capable of sliding removal from the buckle so that the seat belt buckle may be conveniently restored to normal force unbuckling as desired.

Accordingly, the object, feature and advantage of the invention resides in the provision of a molded plastic tubular sleeve which slips over a seat belt buckle and has an integral yieldable flap overlying the pushbutton and depressed in order to depress the pushbutton and unbuckle the buckle.

BRIEF DESCRIPTION OF THE DRAWINGS

These and other features, objects and advantages of the invention will become apparent upon consideration of the specification and the appended drawings in which.

DESCRIPTION OF THE PREFERRED EMBODIMENT

Figure 1:
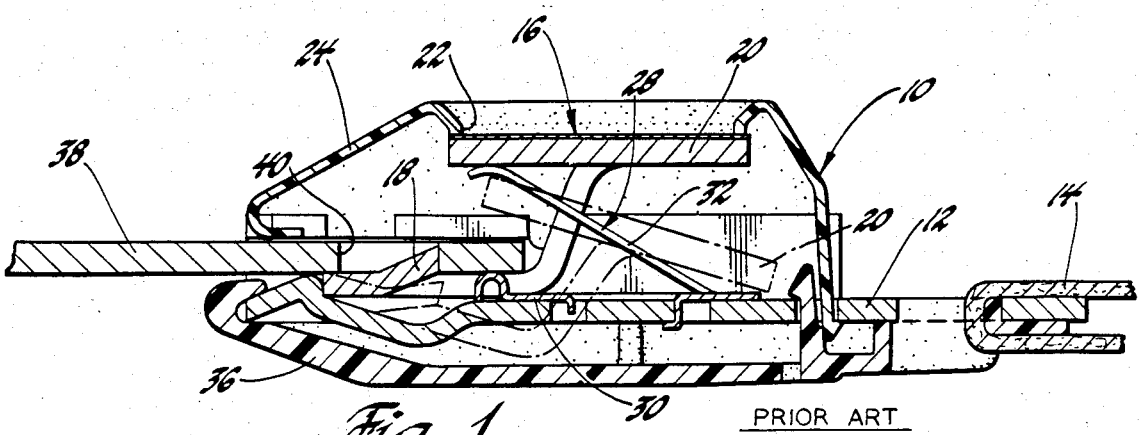
Fig. 1 PRIOR ART
FIG. 1 is a side elevation view of a conventional prior art seat belt buckle.

According to FIG. 1, a conventional seat belt buckle indicated generally at 10 includes a stamped steel buckle body 12 which is connected to a belt 14.

A latch lever 16 is pivotally mounted upon the body 12 and includes a locking tang 18 struck upwardly therefrom. The latch lever 16 also includes a pushbutton 20 which registers with a pushbutton opening 22 in a cover 24 which is suitably attached to the body 12. A spring 28 includes a base portion 30 suitably mounted on the body 12 and a pair of spring leaves 32 and 34 which bear against the underside of the pushbutton 20 to hold the pushbutton 20 in its raised position of FIG. 1. The pushbutton 20 may be depressed to the phantom-line indicated position of FIG. 1 as permitted by resilient yielding movement of the spring leaves 32 and 34. The resultant pivotal movement of the latch lever 16 lowers the locking tang 18 to the phantom-line indicated position of FIG. 1. The buckle also has a plastic bottom cover 36 which snaps onto the underside of the body 12 and has side wall portions 37 and 39.

A latch plate 38 of stamped steel is suitably attached to the other portion of the seat belt and may be inserted into the buckle 10 so that an aperture 40 of the latch plate 38 receives the locking tang 18 of the latch lever 16 to fasten the latch plate 38 within the buckle 10. Depressing the pushbutton 20 to the FIG. 1 phantom-line indicated position lowers the locking tang 18 out of engagement within the aperture 40 of the latch plate 38 so that the latch plate 38 may be removed from the buckle 10, thus separating the seat belt buckle to permit occupant ingress and egress.

Figure 4:
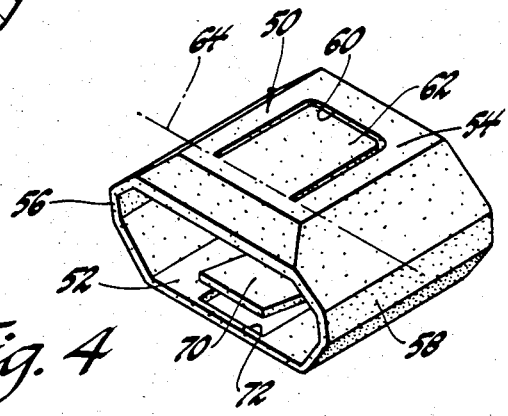
FIG. 4 is a perspective view of the molded plastic tubular sleeve.

The present invention provides a molded plastic tubular sleeve 50, as best seen in FIG. 4. The plastic tubular sleeve may be slid onto the buckle 10, as best seen in FIG. 2, to adapt the buckle to require increased pushbutton effort.

Figure 2:
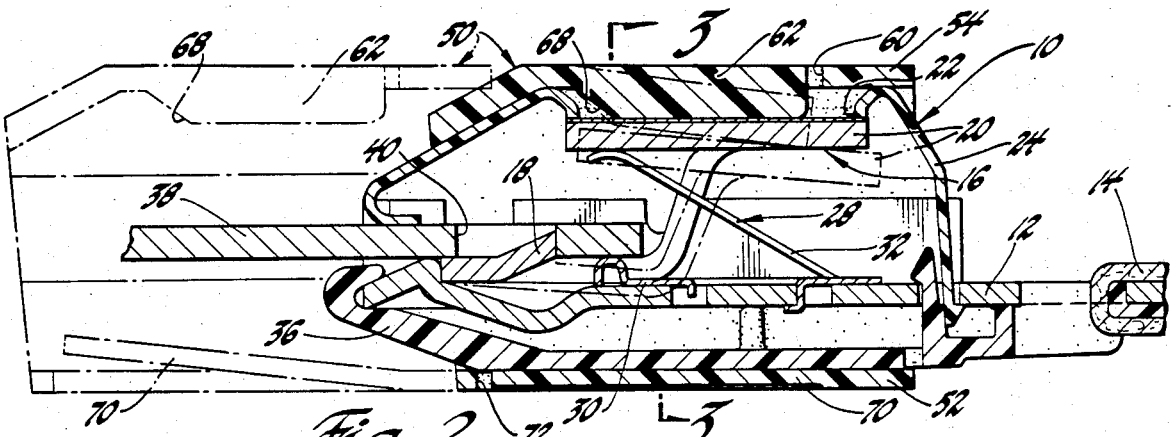
FIG. 2 is a view similar to FIG. 1 but showing the tubular sleeve of this invention installed upon the buckle.
Figure 3:
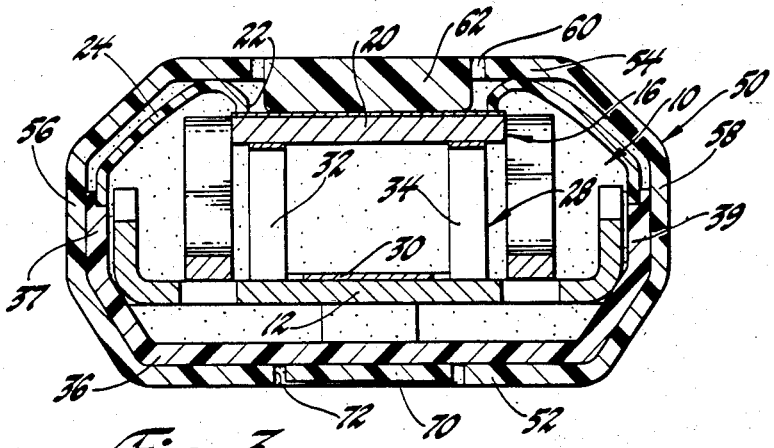
FIG. 3 is a sectional view taken in the direction of arrows 3—3 of FIG. 2.

As best seen in FIGS. 2 and 3, the cross-section of the tubular sleeve 50 is configured to closely surround the cross-section of the conventional seat belt buckle 10. More particularly, as seen in FIGS. 2 and 3, the tubular sleeve 50 includes a bottom wall 52 which bears upon the plastic bottom cover 36 of the buckle, a top wall 54 which bears against the top cover 24 of the buckle 10, and laterally spaced apart side walls 56 and 58 which bear upon the side wall portions 37 and 39 of the buckle.

The top wall 54 of the tubular sleeve includes an integrally molded U-shaped slit 60 which defines an integral pushbutton flap 62 connected to the tubular body by an integral living hinge pivot axis designated 64. As best seen in FIG. 2, the integral pushbutton flap 62 has an increased thickness so that the underside thereof extends downwardly into the pushbutton opening 22 of the top cover 24 and abuts with the pushbutton 20 of the latch lever 16. This thickened underside of the pushbutton flap 62 also functions to retain the tubular sleeve 50 at its installed position upon the buckle 10.

As best seen by reference to FIG. 2, the tubular sleeve 50 may be removed from the buckle 10 by sliding the tubular sleeve 50 leftwardly to the phantom-line indicated position. Such leftward sliding movement of the tubular sleeve 50 is facilitated by the provision of an angled cam face 68 on the underside of the pushbutton flap 62 to impart an upward pivotal movement to the pushbutton flap 62 enabling it to be removed from the pushbutton opening 22 of the buckle top cover 24.

The tubular sleeve 50 is additionally retained at its installed position of FIG. 2 by an integral spring flap 70 which is defined in the bottom wall 52 by a U-shaped slit 72. As best seen in FIG. 4, this spring flap 70 is molded to have a free state raised position shown in FIG. 4 so that, upon sliding installation of the tubular sleeve 50 onto the buckle 10, the flap 70 is cammed downwardly and provides an upward acting spring force on the bottom cover 36 of the buckle to assist in retaining the tubular sleeve 50 on the buckle 10.

Referring to FIG. 2, it will be understood that in order to unfasten the seat belt buckle 10, the seat occupant presses downwardly upon the pushbutton flap 62 of the tubular sleeve 50. Such downward movement of the pushbutton flap 62 to the phantom-line indicated position of FIG. 2 will also depress the pushbutton 20 of the latch lever 16 which underlies the pushbutton flap 62. The amount of force necessary to depress the pushbutton flap 62 depends on such factors as the yieldability of the plastic material from which the tubular sleeve 50 is molded and the thickness of plastic material provided at the hinge axis 64. Thus, the tubular sleeve 50 may be designed to require a level of unbuckling force predeterminedly greater than the force required to depress the pushbutton 20 against the force of the spring 28.

Thus, it is seen that the invention provides a molded plastic tubular sleeve which may be slid onto a seat belt buckle for modifying the buckle to require a greater level of occupant force to unbuckle the buckle.

The embodiments of the invention in which an exclusive property or privilege is claimed are defined as follows:

1. An assembly comprising a seat belt buckle and a device selectively unable for increasing the release force of said seat belt buckle of the type having a brickle housing with a top cover and a spring loaded pushbutton accessible for depression by the occupant through a pushbutton opening recessed below the surface of said top cover of said buckle housing also having a bottom cover, said device comprising:

a molded plastic tubular sleeve slidably and removably installed onto the buckle and having a top wall overlying the top cover of the buckle and a bottom wall underlying the bottom cover of the buckle, said top wall having a U-shaped slit molded integrally therein and defining a pushbutton flap registering with the pushbutton in overlying relationship therewith and integrally connected to the tubular sleeve by an integral living hinge axis, said pushbutton flap having an underside of increased thickness so that the pushbutton flap depends into the pushbutton opening of the buckle housing top cover to thereby retain the sleeve on the buckle and engage with the pushbutton at least upon depression of the pushbutton flap to concomitantly depress the pushbutton of the buckle, said pushbutton flap further having an angled cam face on the underside thereof so that sliding movement of the sleeve to remove the sleeve from the buckle imparts an upward pivotal movement to the pushbutton flap with respect to the pushbutton opening to enable said sliding removal of the sleeve.

2. An assembly comprising a sear belt buckle and a device selectively usable for increasing the release force of said seat belt buckle of the type having a buckle housing with a top cover and a spring loaded pushbutton accessible for depression by the occupant through a pushbutton opening recessed below the surface of said top cover of said buckle housing also having a bottom cover, said device comprising:

a molded plastic tubular sleeve slidably and removably installed onto the buckle and having a top wall overlying the top cover of the buckle and a bottom wall underlying the bottom cover of the buckle, said top wall having a U-shaped slit molded integrally therein and defining a pushbutton flap registering with the pushbutton in overlying relationship therewith and integrally connected to the tubular sleeve by an integral living hinge axis, said pushbutton flap having an underside of increased thickness so that the pushbutton flap depends into the pushbutton opening of the buckle housing top cover to thereby retain the sleeve on the buckle and engage with the pushbutton at least upon depression of the pushbutton flap to concomitantly depress the pushbutton of the buckle, said pushbutton flap further having an angled cam face on the underside thereof so that sliding movement of the sleeve to remove the sleeve from the buckle imparts an upward pivotal movement to the pushbutton flap with respect to the pushbutton opening to enable said sliding removable of the sleeve; and said bottom wall of the tubular sleeve having a U-shaped slit defining an integrally molded spring flap molded to have a free state position extending into the tubular sleeve to bear against the buckle housing and thereby yieldably retain the tubular sleeve upon the buckle.

* * * * *